US008929572B2

(12) United States Patent
Kim et al.

(10) Patent No.: US 8,929,572 B2
(45) Date of Patent: Jan. 6, 2015

(54) METHOD AND APPARATUS FOR EXPANDING LISTENING SWEET SPOT

(75) Inventors: Youngtae Kim, Seongnam-si (KR); Sangchul Ko, Seoul (KR); Jungho Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1809 days.

(21) Appl. No.: 11/604,787

(22) Filed: Nov. 28, 2006

(65) Prior Publication Data

US 2007/0127730 A1 Jun. 7, 2007

(30) Foreign Application Priority Data

Dec. 1, 2005 (KR) ..... 10-2005-0116634

(51) Int. Cl.
*H04R 5/02* (2006.01)
*H04S 1/00* (2006.01)

(52) U.S. Cl.
CPC ..... *H04S 1/002* (2013.01); *H04S 2420/01* (2013.01)
USPC ..... 381/309; 381/17; 381/310; 381/1

(58) Field of Classification Search
USPC ..... 381/1–23, 300–310, 74; 700/94
See application file for complete search history.

(56) References Cited

U.S. PATENT DOCUMENTS 4,159,397 A * 6/1979 Iwahara et al. ..... 381/19
6,243,476 B1 * 6/2001 Gardner ..... 381/303

OTHER PUBLICATIONS

T Nishino et al "Interpolating HRTF for auditory Virtual Reality" The Third joint Meeting ASA and ASJ 1996.12 pp. 1261-1266.*

* cited by examiner

*Primary Examiner* — Xu Mei
(74) *Attorney, Agent, or Firm* — Staas & Halsey LLP

(57) ABSTRACT

A method and apparatus of expanding a listening sweet spot. A method of expanding a listening sweet spot with respect to signals output from speakers includes: obtaining an HRTF (head related transfer function) at a position of a listener's ear; moving a first virtual ear around the position of the listener's ear; obtaining an HRTF at each position of the first virtual ear; and processing a signal to be input to the speakers using the obtained HRTFs to output to the speakers.

17 Claims, 5 Drawing Sheets

METHOD AND APPARATUS FOR EXPANDING LISTENING SWEET SPOT

CROSS-REFERENCE TO RELATED APPLICATION

This application claims the benefit of Korean Patent Application No. 10-2005-0116634, filed on Dec. 1, 2005, in the Korean Intellectual Property Office, the disclosure of which is incorporated herein by reference.

BACKGROUND OF THE INVENTION

1. Field of the Invention

The present invention relates to a method and apparatus for expanding a listening sweet spot using a virtual head related transfer function (HRTF).

2. Description of Related Art

Since there is a difference between two signals input into two ears due to original characteristics of a head transfer system of an individual, a listener can recognize a spatial cue of a sound source. Characteristic information about the difference between the two signals is contained in an HRTF. Therefore, 3D sound can be generated by adding spatial information to a simple sound using the HRTF.

The listener can enjoy the maximum 3D sound effect through a crosstalk cancellation process when positioned in a pre-defined listening sweet spot. The crosstalk cancellation process removes a sound mixing phenomena generated while sounds from a plurality of speakers are transferred to the listener's ears.

FIG. 1A shows a listener 1 positioned in a listening sweet spot. As illustrated in FIG. 1, when the listener 1 faces a position between two speakers S1 and S2, a listening sweet spot 3 is formed. When the listener 1 is positioned in the same distance from each of the two speakers S1 and S2, the listener 1 feels as if a virtual sound source 4 is located on the front axis 5 directly in front of the listener 1.

However, as illustrated in FIG. 1B, when the listener 1 moves to the left of the front axis 5, the listener 1 feels as if the virtual sound source is near the left speaker S1 and consequently deviates from the listening sweet spot 3. It can be consequently known that listen performance changes sensitively according to the relative position of the listener 1 to the listening sweet spot 3.

As described above, since the listening sweet spot is formed by a binaural synthesis system and a crosstalk cancellation system designed using the HRTF between the ears of a fixed listener and speakers at fixed positions, the listening sweet spot is very sensitive to the listener's movement.

BRIEF SUMMARY

An aspect of the present invention provides a method of expanding a listening sweet spot, by moving a position of a virtual ear reflecting the expected movement of a listener instead of moving a position of the listener's actual ear, and canceling crosstalk from signals to be input to speakers using an HRTF corresponding to the virtual ear at each position of a movement path.

According to an aspect of the present invention, there is provided a method of expanding a listening sweet spot with respect to signals output from speakers, the method including: obtaining an HRTF (head related transfer function) at a position of a listener's ear; moving a first virtual ear around the position of the listener's ear; obtaining an HRTF at each position of the first virtual ear; and processing a signal to be input to the speakers using the obtained HRTFs to output to the speakers.

According to another aspect of the present invention, there is provided an apparatus for expanding a listening sweet spot, the apparatus including: an HRTF calculator arranged to calculate HRTFs at a plurality of positions; a crosstalk cancellation function combining portion ranged to combine crosstalk cancellation functions using each of the HRTFs output from the HRTF calculator to yield a combined crosstalk cancellation function; and a crosstalk canceling portion arranged to cancel crosstalk from binaural signals to be input to speakers using the combined crosstalk cancellation function.

According to other aspect of the present invention, there is provided a computer readable media storing instructions that control at least one processor to perform the aforementioned method.

Additional and/or other aspects and advantages of the present invention will be set forth in part in the description that follows and, in part, will be apparent from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1A:
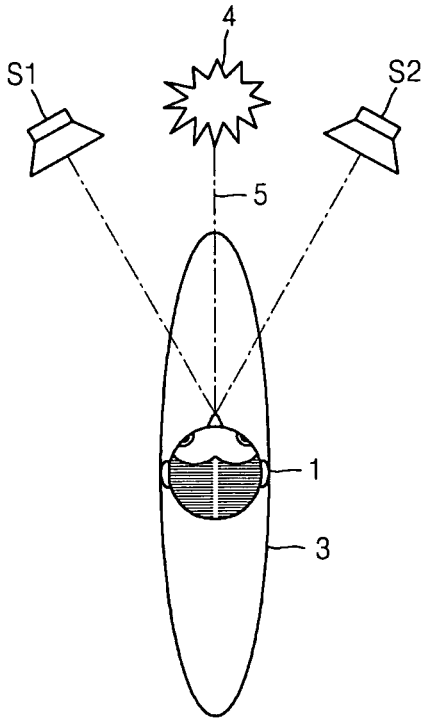
FIG. 1A illustrates a listener positioned in a listening sweet spot.
Figure 1B:
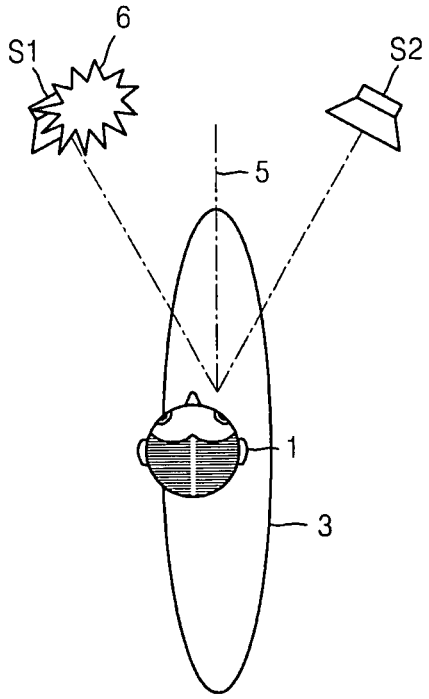
FIG. 1B illustrates a listener deviated from a listening sweet spot.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 2:
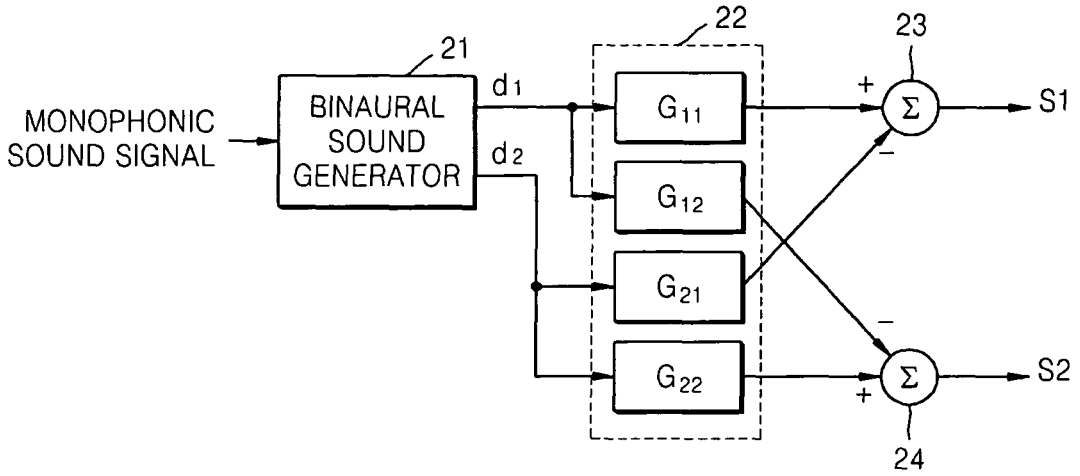
FIG. 2 is a block diagram of a typical apparatus for generating a 3D sound.

FIG. 2 is a block diagram of a typical 3D sound generating apparatus for generating a 3D sound. The 3D sound generating apparatus includes a binaural sound generator 21, a crosstalk canceling portion 22, and first and second combining portions 23 and 24 respectively.

The binaural sound generator 21 generates output signals $d_1$ and $d_2$ of two channels from an input monophonic sound by combining mimic cues of stimuli generated from both ears when a sound is generated at a specified position in an actual space.

The crosstalk canceling portion 22 cancels crosstalk from the output signals $d_1$ and $d_2$ of the two channels. Crosstalk is a phenomenon in which a left speaker output signal leaks to the right ear, or a right speaker output signal leaks to the left ear.

Figure 3:
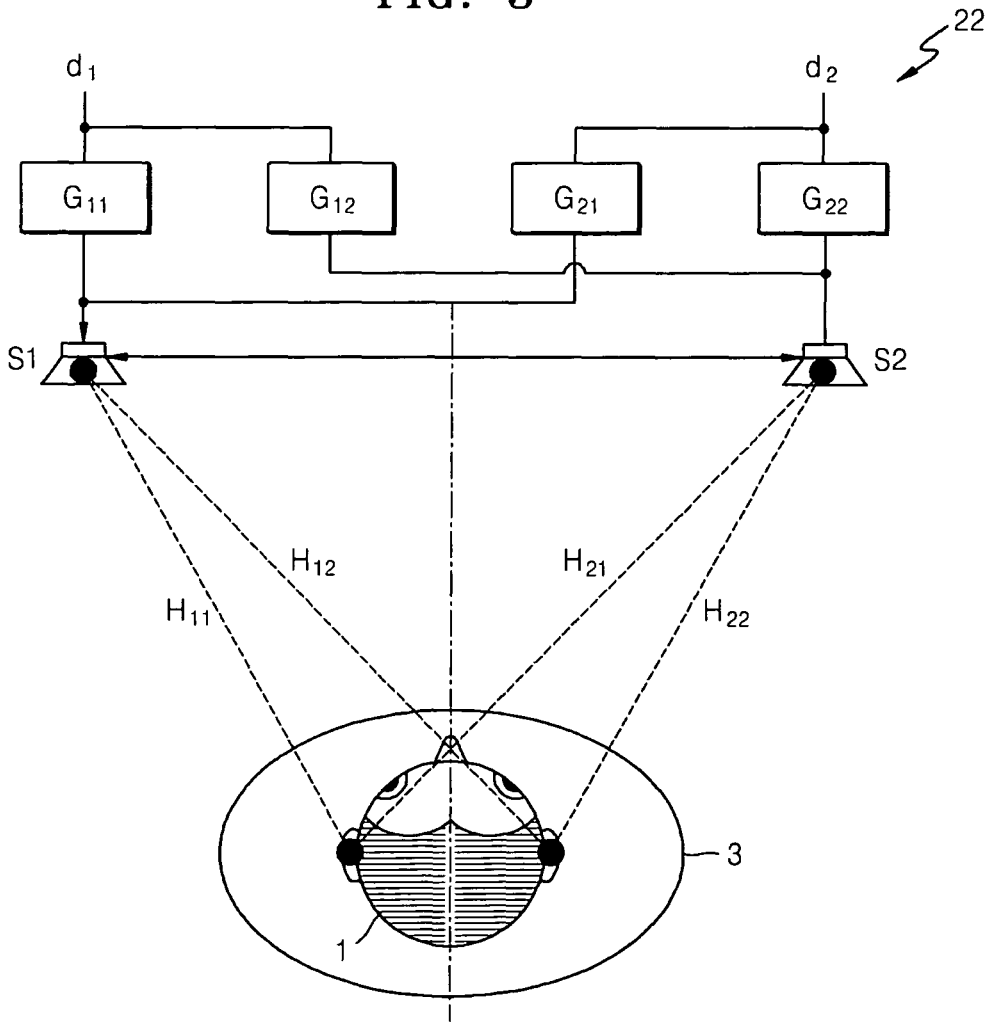
FIG. 3 illustrates a crosstalk canceling portion in FIG. 2 and a listening sweet spot generated by two speakers.

FIG. 3 shows the crosstalk canceling portion 22 of FIG. 2 and a listening sweet spot for two speakers. The crosstalk canceling portion 22 includes a plurality of crosstalk cancellation filters $G_{11}$, $G_{12}$, $G_{21}$, and $G_{22}$. Each crosstalk cancellation filter can be obtained using an HRTF.

As illustrated in FIG. 3, $H_{11}$ represents an HRTF for an output signal of a left speaker S1 transmitted to the left ear, $H_{12}$ represents an HRTF for the output signal of the left speaker S1 transmitted to the right ear, $H_{21}$ represents an HRTF for an output signal of a right speaker S2 transmitted to the left ear, and $H_{22}$ represents an HRTF for the output signal of the right speaker S2 transmitted to the right ear.

The crosstalk cancellation function can be obtained from the HRTFs. Assuming that binaural sound signals output from the speakers S1 and S2 are $x_1$ and $x_2$ respectively and signals reaching two ears of the listener are $y_1$ and $y_2$. As shown in FIG. 3, $y_1$ and $y_2$ are obtained by multiplying the binaural sound signals by a transfer function matrix H according to the following Equation 1.

$$\begin{bmatrix} Y_1 \\ Y_2 \end{bmatrix} = \begin{bmatrix} H_{11} & H_{21} \\ H_{12} & H_{22} \end{bmatrix} \begin{bmatrix} x_1 \\ x_2 \end{bmatrix} \quad \text{Equation 1}$$

Accordingly, the crosstalk cancellation function can be obtained from the inverse function of the HRTF. Additionally, result signals, which are obtained from the binaural sound signal using the crosstalk cancellation function, are transmitted to both speakers S1 and S2. Accordingly, the crosstalk cancellation function can be obtained using the following Equation 2.

$$G = H^{-1} = \frac{1}{(H_{11}H_{22} - H_{12}H_{21})} \begin{bmatrix} H_{22} & -H_{21} \\ -H_{12} & H_{11} \end{bmatrix} \quad \text{Equation 2}$$

When the speakers are symmetrical as illustrated in FIG. 3, $H_{11}=H_{22}$ and $H_{12}=H_{21}$.

Figure 4:
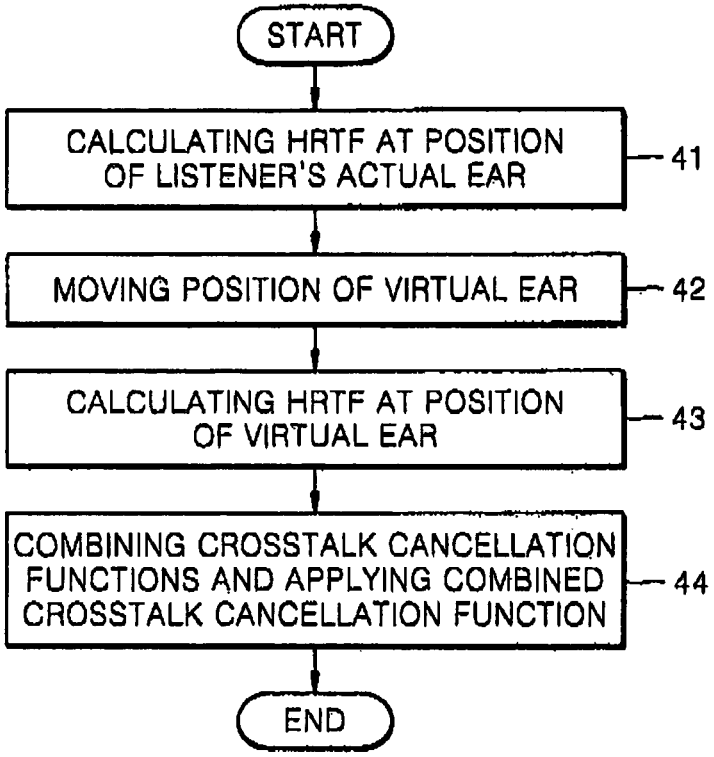
FIG. 4 is a flowchart illustrating a method of expanding a listening sweet spot according to an embodiment of the present invention.

FIG. 4 is a flowchart illustrating a method of expanding a listening sweet spot according to an embodiment of the present invention. As illustrated in FIG. 4, first, the HRTF is calculated for the actual position of the listener's ear, in operation 41. The HRTF can be obtained by performing Fourier transform on an impulse response with respect to the sound that reaches the listener's ear.

Next, the position of a virtual ear is changed along a moving path of the listener, in operation 42, and the HRTF is obtained for each position of the virtual ear, in operation 43. That is, the position of the first virtual ear is moved around the position of the listener's ear, in operation 42. The position of the virtual ear is a position of the listener's ear presumed to be located according to the listener's expected movement. The HRTF at the position of the virtual ear can be obtained experimentally. In the present embodiment, the HRTF can be obtained using HRTFs stored in a database (not shown). The HRTF Cd(jw) at the position of the virtual ear can be obtained by the following Equation 3.

$$C_d(j\omega) \approx \alpha(j\omega) C_h(j\omega) \quad \text{Equation 3}$$

Here, $$\alpha(j\omega) = \frac{C_{c,d}(j\omega)}{C_{c,h}(j\omega)},$$

$C_h$ is the HRTF obtained from the actual position of the listener's ear, $\alpha$ is a correlation factor of the HRTF measured at the position of the virtual ear and the listener's ear, and $C_{c,d}$ and $C_{c,h}$ are values calculated in advance through a simulation and stored in the database.

An algorithm for obtaining $C_{c,d}$ and $C_{c,h}$ through the simulation will now be described in more detail. $C_{c,d}$(jw) represents the HRTF at the position of the virtual ear, and $C_{c,h}$(jw) represents the HRTF at the position of a dummy head's ear. The dummy head has the same size as a person's head and includes a microphone in its ear instead of a real eardrum.

The purpose of the simulation is to obtain $C_{c,d}$ and $C_{c,h}$ at each frequency using a conventional well-defined analytical model.

Figure 5:
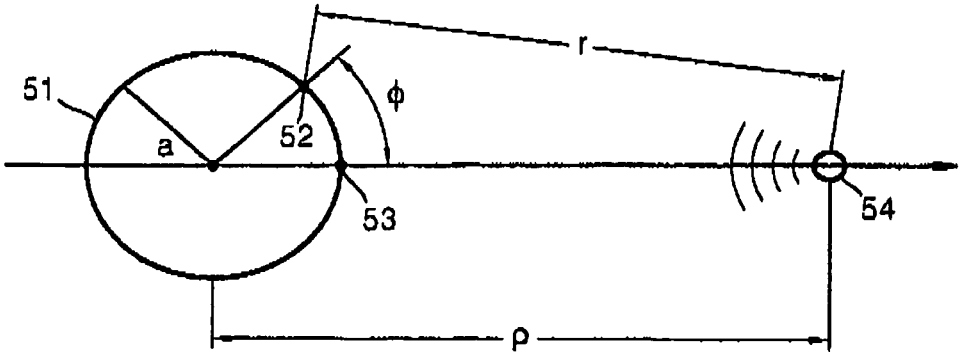
FIG. 5 shows a model for obtaining an HRTF in a position when assuming that the listener's head is a rigid sphere.

FIG. 5 shows a model for obtaining an HRTF in a position when assuming that the listener's head is a rigid sphere. Referring to FIG. 5, a reference numeral 51 represents the sphere, namely, the dummy head, and a reference numeral 52 represents a position of a virtual ear in the dummy head 51. A reference numeral 53 represents a position of the ear of the dummy head 51 and a reference numeral 54 represents a sound source. The distance between the center of the dummy head 51 and the sound source 54 is $\rho$, the radius of the dummy head 51 is a, and the installation angle of a microphone is $\Phi$. HRTF $C_{c,r}$ can be obtained at the position 52 of the virtual ear using the following Equation 4.

$$C_{c,r} = C_{ff}(jw) + C_s(jw) = -\frac{j\rho_0 k}{4\pi} \sum_{m=0}^{\infty} (2m+1) j_m(kr)[j_m(k\rho) - jn_m(k\rho)] p_m(\cos\phi) + \frac{\rho_0 k}{4\pi} \sum_{m=0}^{\infty} b_m [j_m(ka) - jn_m(ka)] p_m(\cos\phi) \quad \text{Equation 4}$$

Here, $$b_m = j(2m+1) j_m(ka) \frac{j_m(kr) - jn_m(kr)}{j_m(ka) - jn_m(ka)},$$

$C_{ff}$ is the HRTF in the center of the sphere, $C_s$ is the HRTF at the surface of the sphere, k and $\rho_0$ are respectively an acoustic wave number and air density, and $j_m$, $n_m$, and $P_m$ are respectively an m-th order spherical Bessel function, an m-th order spherical Neumann function, and a Legendre polynomial of degree m.

According to Equation 3, the HRTF at the position of the virtual ear can be obtained using a obtained from values stored in the database and the HRTF obtained from the position of the actual listener's ear.

Returning to FIG. 4, when the HRTF at each position of the virtual ear is obtained, the HRTFs are combined to output the crosstalk cancellation function, in operation S44. Then, a listening sweet spot can be expanded by applying the filter which is obtained from the obtained crosstalk cancellation function to the binaural sound signals.

Figure 6:
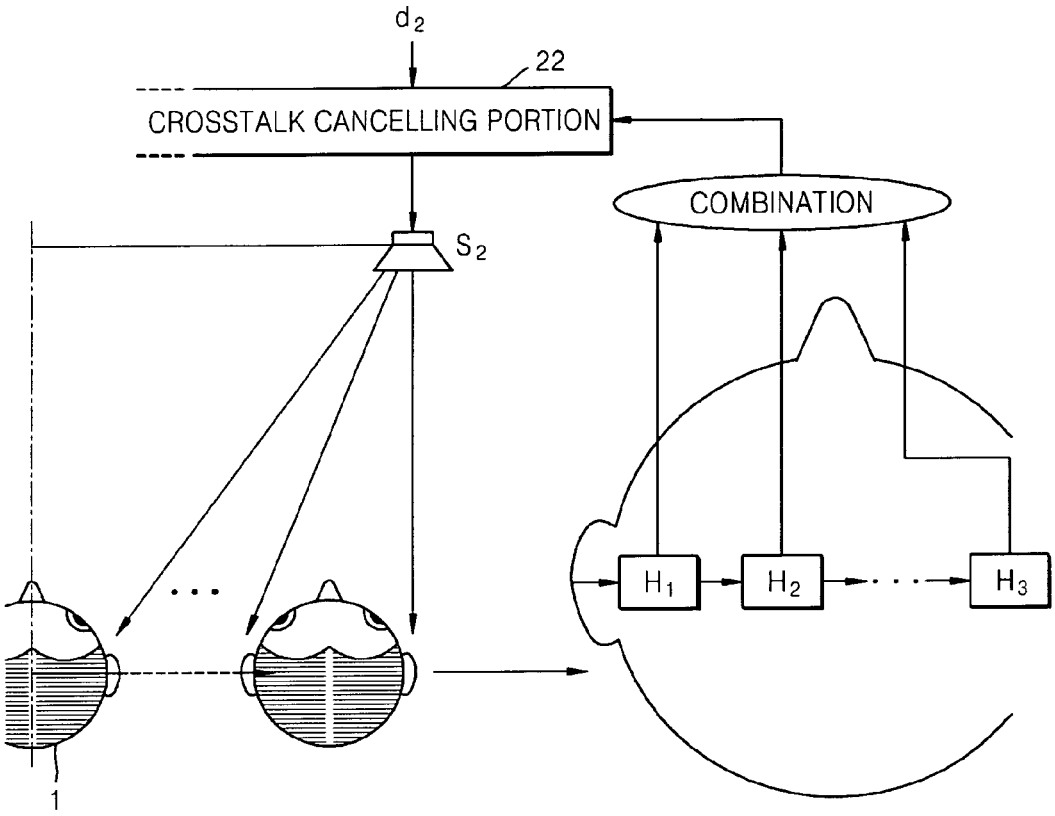
FIG. 6 is a schematic view illustrating a process of combining crosstalk cancellation functions at each position of a virtual ear when the position of the virtual ear is moved according to a path of position changes of a listener.

FIG. 6 is a schematic view illustrating a process of combining the HRTFs to output the crosstalk cancellation functions at each position of the virtual ear when the position of the virtual ear is moved according to position changes of a listener, and providing the obtained crosstalk cancellation function to the crosstalk canceling portion 22 of FIGS. 2 and 3.

The crosstalk cancellation function G can be combined through various methods. For example, the HRTFs obtained from a plurality of virtual ears can be combined to output the crosstalk cancellation function as the following Equation 5.

$$H_i = \begin{bmatrix} H_{i_L1} & H_{i_L2} \\ H_{i_L2} & H_{i_L1} \end{bmatrix} \quad \text{Equation 5}$$

$$a = f(H_{0_L1}, H_{1_L1}, \ldots, H_{n_L1}),$$

$$b = f(H_{0_L2}, H_{1_L2}, \ldots, H_{n_L2})$$

$$H = \begin{bmatrix} a & b \\ b & a \end{bmatrix}, G = H^{-1}$$

Here, $H_i$ is an HRTF obtained from the position of the i-th virtual ear. f( ) is a function for processing the HRTF obtained from the position of each virtual ear. For example, f( ) means to average parameters in parenthesis.

As another example, the crosstalk cancellation function can be obtained by obtaining every crosstalk cancellation function corresponding to each HRTF and combining the every crosstalk cancellation function as the following Equation 6.

$$GH = I \quad \text{Equation 6}$$

$$G_i = H_i^{-1} = \begin{bmatrix} G_{i_1} & G_{i_2} \\ G_{i_2} & G_{i_1} \end{bmatrix}$$

$$a = \phi(G_{0_1}, G_{1_1}, \ldots, G_{n_1}),$$

$$\beta = \phi(G_{0_2}, G_{1_2}, \ldots, G_{n_2})$$

$$G = \begin{bmatrix} \alpha & \beta \\ \beta & \alpha \end{bmatrix}$$

Here, I is a unit matrix and Φ( ) represents a function for processing the crosstalk cancellation function obtained from the position of each virtual ear. For example, Φ( ) means to average crosstalk cancellation functions.

Still another example of a combination of the HRTFs is to combine ratios of the HRTFs of both ears. The combining method is shown by the following Equation 7.

$$H = \begin{bmatrix} H_{L1} & H_{L2} \\ H_{R1} & H_{R2} \end{bmatrix} = \begin{bmatrix} H_{L1} & H_{L2} \\ H_{L2} & H_{L1} \end{bmatrix} = \begin{bmatrix} a & b \\ b & a \end{bmatrix} = a \cdot \begin{bmatrix} 1 & r \\ r & 1 \end{bmatrix} \quad \text{Equation 7}$$

$$a = H_{L1}, b = H_{L2}, r = \frac{b}{a}$$

$$r_i = \frac{b_i}{a_i}$$

$$r = \gamma(r_0, r_1, \ldots, r_n)$$

$$G = \frac{1}{a(r^2 - 1)} \begin{bmatrix} 1 & -r \\ -r & 1 \end{bmatrix}$$

Here, γ( ) represents a function for processing parameters in the parenthesis. For example, γ( ) averages the parameters in parenthesis.

Figure 7:
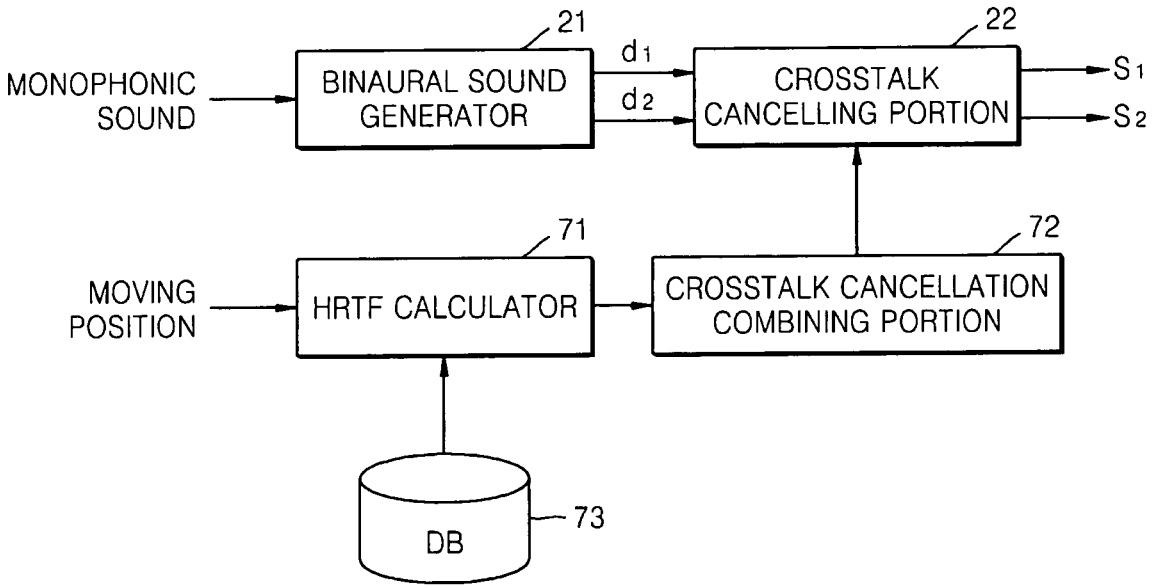
FIG. 7 is a block diagram of an apparatus for expanding a listening sweet spot according to an embodiment of the present invention.

FIG. 7 is a block diagram of an apparatus for expanding a listening sweet spot according to an embodiment of the present invention. The apparatus for expanding a listening sweet spot includes a binaural sound generator 21, a crosstalk canceling portion 22, an HRTF calculator 71, and a crosstalk cancellation function combining portion 72. Additionally, the apparatus for expanding a listening sweet spot can further include a database 73 storing values of a plurality of HRTFs.

The binaural sound generator 21 generates binaural sound signals $d_1$ and $d_2$ from a monophonic sound. The HRTF calculator 71 calculates the HRTFs using Equations 3 and 4 according to the moving position of the virtual ear. The crosstalk cancellation function combining portion 72 outputs the crosstalk cancellation function using any one of Equations 5 through 7 on the basis of the HRTFs generated by the HRTF calculator 71. The crosstalk canceling portion 22 receives coefficients of the crosstalk cancellation function from the crosstalk cancellation function output by the crosstalk cancellation function combining portion 72, and then filters the binaural sound signals to output to the two speakers S1 and S2.

Figure 8:
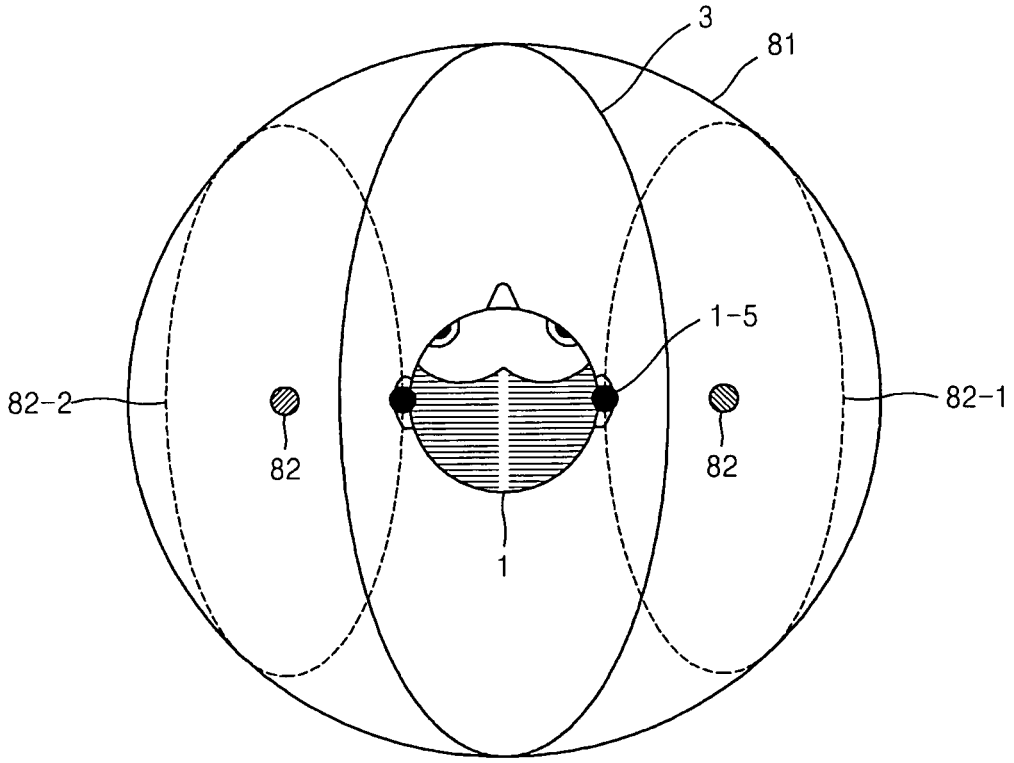
FIG. 8 illustrates listening sweet spots according to the present invention and the conventional technique.

FIG. 8 illustrates listening sweet spots according to an embodiment of the present invention and the conventional technique. Reference numeral 1-5 represents the actual ear of the listener 1, and reference numeral 82 represents the virtual ear. A reference numeral 3 represents a listening sweet spot obtained from the position of the actual ear. Additionally, reference numerals 82-1 and 82-2 represent listening sweet spots obtained from each position of the virtual ear 82. A reference numeral 81 represents an expanded listening sweet spot. As illustrated in FIG. 8, the listening sweet spot according to the present invention is formed by a combination of the listening sweet spots 82-1 and 82-2, each of which is formed at the position of the virtual ear 82. Thus, the listening sweet spot of the present invention is larger than the conventional listening sweet spot 3 formed at the position of the listener's actual ear.

According to the above-described embodiment of the present invention, the listening sweet spot can be expanded to a larger area compared with the conventionally obtained sweet spot by canceling crosstalk with the listener's movement. Consequently, the present invention can provide a multi-channel sound listening system robust to the listener's movement.

Embodiments of the present invention include computer readable code/instructions in/on a medium, e.g., a computer readable medium. Such a medium can be any medium/media permitting the storing and/or transmission of the computer readable code.

The computer readable code/instructions can be recorded/transferred in/on a medium in a variety of ways, with examples of the medium including magnetic storage media (e.g., ROM, floppy disks, hard disks, etc.), optical recording media (e.g., CD-ROMs, or DVDs), random access memory media, and storage/transmission media such as carrier waves. Examples of storage/transmission media may include wired or wireless transmission (such as transmission through the Internet). The medium may also be a distributed network, so that the computer readable code/instructions is stored/transferred and executed in a distributed fashion. The computer readable code/instructions may be executed by one or more processors.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of expanding a listening sweet spot of signals output from speakers, the method comprising:

obtaining a head related transfer function (HRTF) at an actual position of a listener's ear;

moving a first virtual ear to a first position different than the actual position of the listener's ear according to an expected movement of the listener;

obtaining an HRTF at the first position of the first virtual ear;

combining crosstalk cancellation functions corresponding to each of the HRTF at the actual position of the listener's ear and the HRTF at the first position of the first virtual ear to yield a combined crosstalk cancellation function; and processing a signal to be input to the speakers using the combined crosstalk cancellation function, thereby expanding the listening sweet spot to an area larger than a listening sweet spot obtained using just the actual position of the listener's ear.

2. The method of claim 1, wherein, in the obtaining an HRTF, each of the HRTFs is obtained by multiplying the HRTF at the actual position of the listener's ear by a corresponding correlation factor.

3. The method of claim 2, wherein the correlation factor is determined by a ratio of an HRTF at a position of a dummy head's ear to an HRTF at a position of a second virtual ear.

4. The method of claim 3, wherein the HRTF at the position of the second virtual ear and the HRTF at the position of an ear of the dummy head are calculated and stored in a database in advance.

5. The method of claim 1, wherein the processing comprises:

obtaining an HRTF at a second position of the first virtual ear;

combining identical components of the HRTFs obtained at each position of the first virtual ear to yield a combined HRTF;

obtaining an inverse function of the combined HRTF; and multiplying the signal to be input to the speakers by the inverse function.

6. The method of claim 1, wherein a crosstalk cancellation function corresponding to the first HRTF and a crosstalk cancellation function corresponding the second HRTF are combined and the combined crosstalk cancellation function is used to filter binaural sound signals.

7. A method of expanding a listening sweet spot of signals output from speakers, the method comprising:

obtaining a head related transfer function (HRTF) at an actual position of a listener's ear;

moving a first virtual ear to a first position different than the actual position of the listener's ear according to an expected movement of the listener;

obtaining an HRTF at the first position of the first virtual ear; and processing a signal to be input to the speakers using a combination of the HRTF obtained at the actual position of the listener's ear and the HRTF obtained at the first position of the first virtual ear, wherein the processing of the signal comprises:

obtaining an HRTF at a second position of the first virtual ear;

obtaining inverse functions of the HRTFs obtained at each position of the first virtual ear, combining identical components of the inverse functions; and multiplying the signal to be input to the speakers by the combined identical components.

8. A method of expanding a listening sweet spot of a signals output from speakers, the method comprising:

obtaining a head related transfer function (HRTF) at an actual position of a listener's ear;

moving a first virtual ear to a first position different than the actual position of the listener's ear according to an expected movement of the listener;

obtaining an HRTF at the first position of the first virtual ear; and processing a signal to be input to the speakers using a combination of the HRTF obtained at the actual position of the listener's ear and the HRTF obtained at the first position of the virtual ear, wherein the processing of the signal comprises:

obtaining an HRTF at a second position of the first virtual ear;

representing the HRTFs obtained at each position of the first virtual ear as ratios of an HRTF of one side ear to an HRTF of another side ear;

combining the ratios;

obtaining a combined inverse function to the HRTFs using the combined ratios; and multiplying the signal to be input to the speakers by the inverse function.

9. An apparatus for expanding a listening sweet spot, the apparatus comprising:

a HRTF calculator calculating head related transfer function (HRTF) at an actual position of a listener's ear and calculating a plurality of HRTFs at a plurality of positions of a first virtual ear, different than the actual position of the listener's ear, according to an expected movement of the listener;

a crosstalk cancellation function combining portion combining crosstalk cancellation functions corresponding to each of the plurality of HRTFs output from the HRTF calculator to yield a combined crosstalk cancellation function; and a crosstalk canceling portion canceling crosstalk from binaural signals to be input to speakers using the combined crosstalk cancellation function, thereby expanding the listening sweet spot to an area larger than a listening sweet spot obtained using just the actual position of the listener's ear, wherein at least one of the HRTF calculator, the crosstalk cancellation function combining portion, and the crosstalk canceling portion is implemented as a hardware component.

10. The apparatus of claim 9, wherein the HRTF calculator calculates each of the plurality of HRTFs at each position of the first virtual ear by multiplying the HRTF at the position of the listener's ear by a corresponding correlation factor.

11. The apparatus of claim 10, further comprising a dummy head, wherein the HRTF calculator obtains a HRTF at a position of an ear of the dummy head and HRTFs at positions of a second virtual ear around the dummy head, and determines the correlation factor as the ratio of the HRTF at the position of the ear of the dummy head to each of the HRTFs at each position of the second virtual ear.

12. The apparatus of claim 10, further comprising a database storing the HRTFs at each position of the second virtual ear and the HRTF at the position of the dummy head's ear in advance, wherein the HRTF calculator reads each of the HRTFs at each position of the second virtual ears and the HRTF at the position of the dummy head's ear from the database to obtain the corresponding correlation factor.

13. The apparatus of claim 9, wherein the crosstalk cancellation function combining portion combines identical components of the HRTFs obtained at each position of the first virtual ear, obtains an inverse function to the combined HRTF, and outputs the inverse function to the crosstalk canceling portion as the crosstalk cancellation function.

14. The apparatus of claim 9, wherein the crosstalk cancellation function combining portion obtains inverse functions to the HRTFs obtained at each position of the first virtual ear, combines identical components of the inverse functions, and outputs the combined identical components to the crosstalk canceling portion as the crosstalk cancellation function.

15. The apparatus of claim 9, wherein the crosstalk cancellation function combining portion represents the HRTFs obtained at the positions of the first virtual ear as ratios of an HRTF of one side ear to an HRTF of another side ear, combines the ratios, obtains a combined inverse function to the HRTFs using the combined ratios, and outputs the inverse function to the crosstalk canceling portion as the crosstalk cancellation function.

16. A non-transitory computer readable medium storing instructions that control at least one processor to perform a method comprising:

obtaining a head related transfer function (HRTF) at an actual position of a listener's ear;

moving a first virtual ear to a first position different than the actual position of the listener's ear according to an expected movement of the listener;

obtaining an HRTF at the first position of the first virtual ear;

combining crosstalk cancellation functions corresponding to each of the HRTF at the actual position of the listener's ear and the HRTF at the first position of the first virtual ear to yield a combined crosstalk cancellation function; and processing a signal to be input to the speakers using the combined crosstalk cancellation function, thereby expanding the listening sweet spot to an area larger than a listening sweet spot obtained using just the actual position of the listener's ear.

17. The non-transitory medium of claim 16, wherein the combined crosstalk cancellation function is used to filter binaural sound signals.

* * * * *